United States Patent [19]

Lemelson

[11] 4,075,717

[45] Feb. 28, 1978

[54] HELMATE

[76] Inventor: Jerome H. Lemelson, 85 Rector St., Metuchen, N.J. 08840

[21] Appl. No.: 651,566

[22] Filed: Jan. 22, 1976

Related U.S. Application Data

[63] Continuation-in-part of Ser. No. 553,914, Feb. 28, 1975, abandoned, which is a continuation-in-part of Ser. No. 300,248, Oct. 24, 1972, Pat. No. 3,875,275, which is a continuation of Ser. No. 744,048, July 11, 1968, abandoned.

[51] Int. Cl.[2] ..... A42B 3/02

[52] U.S. Cl. ..... 2/412

[58] Field of Search ..... 2/410, 411, 412, 413, 2/421, 425

[56] References Cited

U.S. PATENT DOCUMENTS

| | | | |
|---|---|---|---|
| 3,314,077 | 4/1967 | Marchello | 2/421 |
| 3,365,725 | 1/1968 | Webb | 2/413 |
| 3,462,763 | 8/1969 | Schneider et al. | 2/413 |
| 3,501,772 | 3/1970 | Wyckoff | 2/425 X |
| 3,616,463 | 11/1971 | Theodore et al. | 2/412 |
| 3,668,704 | 6/1972 | Conroy et al. | 2/413 |
| 3,763,494 | 10/1973 | Nordskog | 2/421 |
| 3,818,508 | 6/1974 | Lammers et al. | 2/412 |
| 3,935,044 | 1/1976 | Daly | 2/412 X |

*Primary Examiner*—Alfred R. Guest

[57] ABSTRACT

A head protection unit in the form of a helmet made of composite plastic materials. The helmet is formed of a unitary plastic molding having a wall with an outer shell portion joined to an inner shell portion along the lower edge of the helmet and containing a core portion between the inner and outer shell portions which core portion is made of cellular plastic material. Combinations of flexible and rigid plastic resins may be employed for the shell portions and the core portion. Fittings for attaching a chin strap, goggles or face protector may be secured to the peripheral portions of the composite molding after the molding is produced or as inserts disposed in the mold during the molding procedure. In one form, the inner shell portion is made of a flexible plastic and is ribbed or corrugated. In another form, the core portion is made of two different cellular plastic materials, one more rigid than the other to provide impact resistance.

9 Claims, 6 Drawing Figures

HELMATE

RELATED APPLICATIONS

This is a continuation-in-part of application Ser. No. 553,914 filed Feb. 28, 1975 now abandoned as a continuation-in-part of Ser. No. 300,248 filed Oct. 24, 1972 now U.S. Pat. No. 3,875,275, a continuation of Ser. No. 744,048 filed July 11, 1968, now abandoned.

SUMMARY OF THE INVENTION

This invention relates to improvements in head gear, particularly constructed to protect the head of the wearer against impact or blower. In particular the invention is directed to a plastic helmet and the like which is manufactured by molding a plurality of different plastic materials, one of which is a cellular plastic and comprises a core molded in situ between outer and inner wall portions of a shell which may be made of a unitary material or of two different materials. A so-called sandwich molding technique may be employed to form the helmet by simultaneously injecting a non-cellular and a cellular plastic into a mold wherein the non-cellular plastic conforms to the wall of the mold and the cellular plastic expands in situ against the inside surface of the non-cellular plastic. A second molding technique employs rotationally molding a first plastic in a mold to provide the general configuration of the helmet and thereafter injecting a self-expanding plastic resin into the shell so formed to completely fill, when expanded, the volume interior of the inner and outer wall portions of the shell. Such molding techniques are relatively inexpensive and provide a helmet structure which is superior to helmets which are formed by laminating two or more moldings together.

Accordingly, it is a primary object of this invention to provide new and improved structures in plastic helmets or head gear designed to protect the head of the wearer.

Another object is to provide a new and improved plastic head protector which is formed of a molded lamination of rigid and flexible plastic resins.

Another object is to provide a helmet for protecting the head of the wearer which is formed of a molded, multi-layer plastic shell having an outer portion of rigid plastic material and one or more inner portions molded in situ with the outer portion and made of one or more plastic materials which are more flexible than the material forming the outer portion.

Another object is to provide a composite plastic helmet formed of a unitary plastic molding.

Another object is to provide a multi-layer plastic helmet having fittings which are integrally secured thereto by molding.

Another object is to provide a composite wall plastic helmet having an inner wall portion which is irregularly shaped by molding to permit air to circulate between the head of the wearer and the wall of the helmet.

Another object is to provide a composite plastic helmet formed of at least four distinct layers including at least two outer layers made respectively of rigid non-cellular and cellular plastics and two inner layers made of cellular and non-cellular plastics of less rigidly and greater flexibility than the two outer layers.

With the above and such other objects in view as will hereafter more fully appear, the invention consists of the novel constructions, combinations and arrangements of parts described in the accompanying specification and drawings but it is to be understood that changes, variations and modifications may be resorted to without departing from the spirit and nature of the invention.

Figure 1:
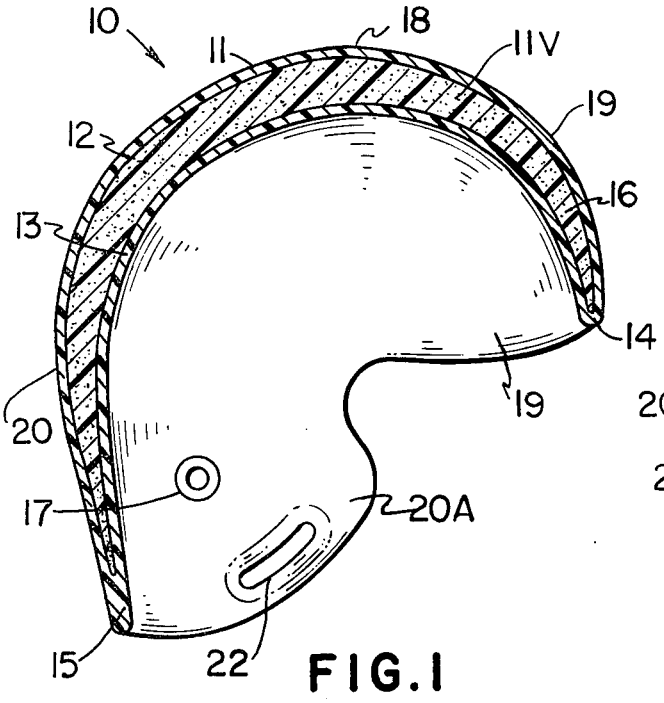
FIG. 1 is a side cross sectional view of a first structure in a composite wall helmet defining the instant invention.

In FIG. 1 is shown a helmet 10 formed of a unitary plastic molding 11 with a plurality of fittings, one of which 17 is illustrated. The molding 11 may be formed by so called "sandwich molding" developed by International Chemicals, Inc. in which a non-cellular and a self-expanding plastic are simultaneously injected into a mold wherein the non-cellular plastic is caused to flow along the surfaces of the mold wall while the self-expanding plastic expands in situ therein. The molding 11 may also be produced by rotationally molding a first non-cellular plastic to form inner and outer wall portions 12 and 13 into a hollow configuration defining the general shape of the helmet and injecting into the interior of said hollow configuration a self-expanding plastic which may be either rigid or flexible in characteristic. Depending on the characteristics desired of the self-expanding plastic such as the size of the cells thereof, it may be injected while the shell is retained in the mold in which it is formed or in a restraining form after it has been removed from said mold to prevent unwanted deformation of any portion of the wall of the shell or it may be injected therein after the shell has been removed from the mold. For example, the expansion characteristics of the cellular plastic forming a core portion 16 and of the quantity thereof may be such that said plastic will completely fill the interior volume 11V of the molding 11 by the time it completely expands. To insure that the expanding plastic will completely fill volume 11V, the mold or form containing the hollow shell molding may be predeterminately moved during or after the injection of the self-expanding plastic therein and/or the quantity of self-expanding plastic may be such that it will exert some force against the outer and inner wall portions 12 and 13 of the shell before the expansion process has been completed.

The molding 10 is formed with a dome-shaped crown portion 18 for protecting the top of the head and the major portion of the skull of the wearer, a front portion 19 covering and extending around the forehead of the wearer and a rear portion 20 composed of side portions 20A and 20B which extend below the ears of the wearer and back portion 20C joining said side portions and extending around the lower portion of the neck of the wearer.

Notation 21 refers to reinforced or expanded portions of the side portion 20A and 20B of helmet 11 which expanded portions accommodate respective loop-shaped metal fittings 29 which are preferably secured to the molding by molding rigid plastic material forming at least the outer wall 12 of the shell and the rim portion 16 thereof over respective portions of the fittings during the molding of the shell. The fittings 29 may be somewhat rectangularly shaped metal or plastic rings or otherwise shaped metal stampings for retaining the ends or looped portions of a chin strap in place.

Figure 5:
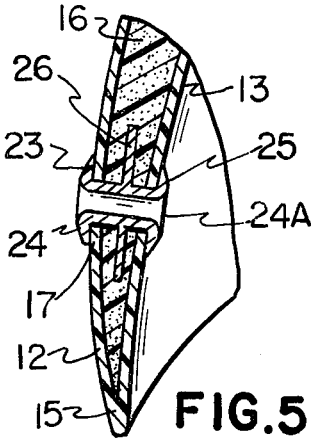
FIG. 5 is a fragmentary view of a portion of the helmet of the type shown in FIGS. 1–4 illustrating a hollow tubular fitting attached thereto.

In place of fittings 29, a slotted opening 22 may be molded in each of the side portions 20A and 20B of the rear portion of the molding and the wall of said opening may be composed of rigid plastic material forming at least the outer shell 12. The elongated opening 22 may also be reinforced by an elongated metal grommet of conforming configuration or may be replaced by respective fittings secured to the portions 20A and 20B by means of tubular rivets or grommets 23 which are molded in or fastened through openings 17 in the portions 20A and 20B, as illustrated in FIG. 5. The grommet 23 may be one of a number of grommets provided in the portions 20A and 20B for retaining such objects as metal fittings for retaining a chin strap assembled to the helmet, pluggable connection means for a loud speaker to permit the wearer of the helmet to listen to broadcast information or a microphone which extends outwardly from the helmet. The grommets 23 may also be integrally molded to the outer and inner walls 12 and 13 by placing same in the mold before the molding thereof and retaining each, for example, against a specially shaped portion of the mold cavity wall or a removeable pin disposed in a cavity in the mold wall.

Notation 27 refers to a plurality of grommets or otherwise shaped fittings which are secured to or integrally molded with the front portion 19 of the helmet for retaining a visor, goggles or other means in assembly therewith.

Figure 4:
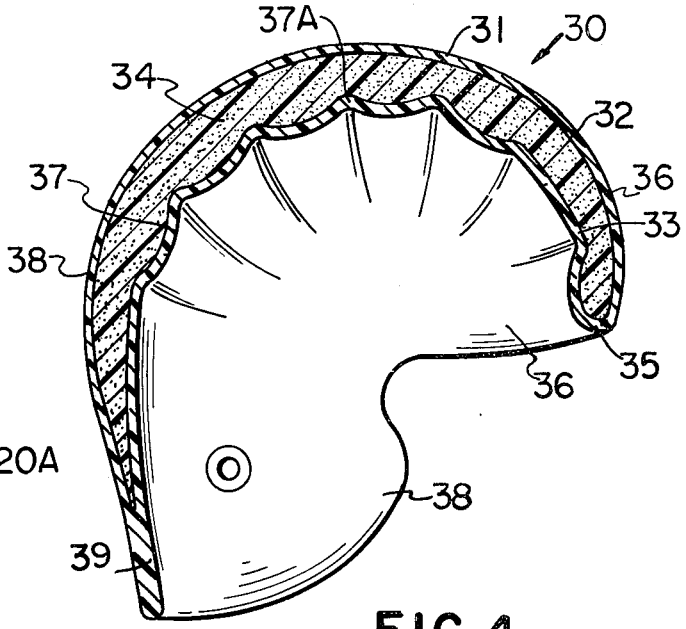
FIG. 4 is a side cross-sectional view of a modified form of the helmet shown in FIG. 1.

FIG. 4 illustrates a modified form of helmet 30 comprising a molding 31 having outer and inner wall portions 32 and 33 formed of non-cellular plastic and a core portion 34 formed of a cellular plastic which is expanded in situ within the shell-like molding 31. The front portion 36 of the helmet which extends around the forehead of the wearer is defined at its lower portion by a portion 35 of the shell molding joining the outer and inner walls 32 and 33 while the rear portion 38 of the helmet is defined by a non-cellular plastic portion 39 joining the outer and inner walls 32 and 33 and extending a substantial distance upwardly from the lower rim of the portions of the helmet covering the ears and neck of the wearer.

The inside wall 33 of the helmet is formed with a plurality of corrugations 37 which are shaped to provide portions 37A of the inner wall away from the head of the wearer to permit air to circulate above the head of the wearer and also to provide an improved cushioning effect.

Materials of which the helmet structures illustrated in FIGS. 1–5 may be molded include such engineering plastics as ABS, polycarbonate, rigid polyvinylchloride, polypropylene, acetyl, cellulose acetate butyrate, polystyrene or other high impact resistant plastic polymer. While such polymers may also be utilized for the inside wall of the helmet, for many applications more flexible plastics such as medium or low density polyethylene, plasticized polyvinylchloride, polypropylene, ethylene vinyl acetate, butadiene styrene, vinyl acetate-ethylene or other suitable flexible plastic may be employed. The material of which the cellular plastic core may be molded in situ within the shell may comprise rigid, semi-rigid or flexible materials depending again upon what characteristics are desired to be imparted to the helmet. Rigid or flexible polyurethane, polyvinylchloride, ethylene vinyl acetate, polyethylene or other suitable expandable plastic may be utilized for the core portion of the helmet.

Requisite variations in rigidity between the outer wall and the inner wall portions of the helmet may also be obtained utilizing the same plastic polymer by controlling mold movement and position during molding to provide the outer wall of the shell substantially greater in thickness than the inner wall portion thereof. In other words, if a plastic such as high density polyethylene or polypropylene is employed to mold the shell, the mold may be retained with the portion of the mold wall defining the outer wall of the molding in a downward position for a longer period of time than the retention of the portion of the mold wall cavity defining the inner wall portion while the mold is heated so that the outer wall portion of the shell is formed substantially greater in thickness than the inner wall portion resulting in a shell molding having a thicker outer wall than an inner wall wherein the inner wall has a greater degree of flexibility and may yield to a greater extent during impact than the outer wall thereof.

In a preferred embodiment of the invention illustrated in FIG. 1, the shell molding defining the outer and inner walls 12 and 13 is formed of a suitable high impact resistant plastic such as polypropylene, high density polyethylene, acetyl or polycarbonate resin with the outer wall 12 being in the range of $\frac{1}{8}$ – $\frac{1}{4}$ inch thick and the inner wall 13 in the range of 1/32 – $\frac{1}{8}$ inch thick and the core portion thereof filled with a flexible cellular plastic material such as expanded medium or low density polyethylene, flexible polyurethane, vinyl acetate-ethylene, butadiene styrene, ionomer or other suitable yieldable resin having a stratum thickness which varies from $\frac{1}{8}$ to 1 inch or more in the crown portion 18 of the helmet. The use of medium or low density polyethylene or a flexible polyurethane resin which will permit suitable yieldability thereof during impact.

In a preferred embodiment of the helmet illustrated in FIG. 4, the outer wall 32 of the shell molding is preferably formed $\frac{1}{8}$ – $\frac{1}{4}$ inch thick of high impact plastic such as polypropylene, high density polyethylene, acetyl, polyurethane or other suitable high impact resistant plastic resin while the inner wall 33 is preferably formed of a more flexible material such as a more flexible polyurethane, plasticized polyvinylchloride, medium density polyethylene, ethylene vinyl acetate or is of substantially less wall thickness than the outer wall to permit the corrugated portions 37 thereof to deform under impact.

Figure 6:
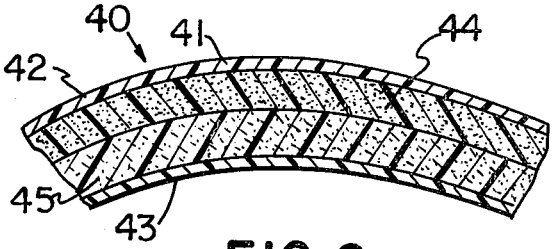
FIG. 6 is a cross-sectional view of a portion of a helmet of the type shown in FIGS. 1–5 but modified wherein the core portion thereof is formed of at least two distinct and separate cellular plastic materials, one of which may be rigid and the other flexible or both of may be rigid or flexible but of different densities.

In FIG. 6 is shown another structure in a molded plastic helmet 40 which is defined by a shell molding 42 configured as illustrated in FIGS. 1–5 with an outer wall portion 42 and an inner wall portion 43 constructed and formed of any of the plastic resin materials or combinations thereof described above. Disposed between the outer and inner wall portions within the shell molding are a plurality of layers of cellular plastic resin, illustrated although not necessarily restricted to the two layers 44 and 45 shown. Layer 44 is illustrated as disposed against the inside surface of the outer wall portion 42 of the shell molding 41 while layer 45 fills the remaining volume between layer 44 and the inside surface of the inner wall portion 43. Layer 44 is preferably formed of a cellular plastic resin which is greater in rigidity or density than layer 45 which is more flexible than the outer layer.

While layers 44 and 45 are illustrated in FIG. 6 as being of substantially equal thickness, they may be varied in thickness depending on the impact resistance and yieldability required of the core material. In other words, the layers 44 and 45 are so configured and are of such cellular plastic materials as to impart suitable impact resistance to the molded helmet as well as yieldability during impact. The rigid foam plastic layer 44 is of such a thickness and characteristic as to support the outer wall 42 against destruction or buckeling and to protect the head of the wearer by absorbing some degree of the impact force and preventing destruction or permanent deformation of the outer portion of the helmet while layer 45 serves to absorb a substantial portion of the impact force and support the inner layer 43.

In the structure illustrated in FIG. 6, the shell molding 41 may be composed of a unitary plastic or a combination of plastics including a rigid, impact resistant plastic for the outer wall or layer 42 and a more flexible plastic for the inner wall 43. As described above, the shell molding 41 may also have its outer wall portion 42 substantially greater in thickness than the inner wall portion 43 to render the outer wall portion highly impact resistant yet permit the inner wall portion to deform to some degree to protect the skull of the wearer. The outer layer 44 may comprise such rigid or impact resistant resinous materials as rigid polyurethane, rigid polyvinyl chloride, polypropylene or high density polyethylene foams while the inner layer 45 may comprise lower density formulations of polyethylene, polyurethane and plasticized polyvinylchloride.

While the helmet 40 of FIG. 6 may be formed by laminating premolded layers of non-cellular and cellular plastic moldings together, it may also be formed by suitably controlling the injection of the respective plastic materials into a rotational mold and controlling the attitude of the mold with respect to the horizontal as described above. In other words, the layers 42 and 44 are formed by injecting the plastic materials thereof into the mold while the wall of the mold which forms the outer surface of the wall 42 of the molding is disposed downwardly. Layers 43 and 45 may also be formed when said mold is so disposed after the layers 42 and 44 have been formed although in a preferable method, layer 43 is formed while the inside surface thereof is disposed against the mold wall while it is facing upwardly.

The helmet 40 of FIG. 6 may also be formed by the so-called, above described sandwich molding technique as may the configurations of FIGS. 1–5. In such a technique, a plurality of separate streams of the plastics forming the shell and core portions of the molding are simultaneously and controllably injected through the same or different inlets ports into the mold to form the composite molding of FIG. 6.

If the helmet 40 of FIG. 6 is formed of separately molded components, it may be joined along the abutting portions of said separately molded components by ultrasonic welding means employing dies which completely weld the portions together during the single pass of said dies.

Figure 3:
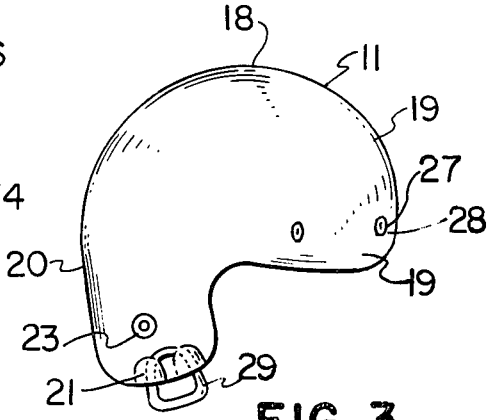
FIG. 3 is a side view of a modified form of the helmet shown in FIGS. 1 and 2.
Figure 2:
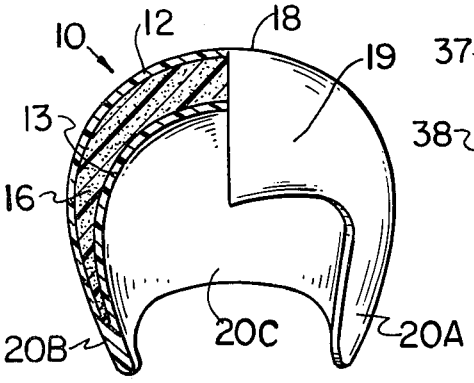
FIG. 2 is a partially sectioned front view of a helmet of the type illustrated in FIG. 1.

Details of one form of tubular fastener, such as grommet fasteners 23 and 28 of FIG. 3 employed to removably or pivotally retain chin straps, goggles, face shields, communication equipment or other devices in assembly with the helmate, are shown in FIG. 5. The fastener 23 is shown having opposite outwardly flared heads 24A and 24, a tubular shank portion 25 and a disc shaped portion 26 attached to or formed intengral with the central portion of shank 25 and of greater diameter than the heads 24 and 24A of the fastener. Disc shaped portion 26 retains the fastener 23 firmly within the cellular plastic core portion 16 while the heads 24 and 24A may be secured to or within the outer and inner shell walls 12 and 13 by molding plastic in situ thereagainst.

I claim:

1. A headgear for use in protecting the head of the wearer comprising:

a bowl-shaped shell-like molding formed of a plurality of layers of plastic materials including:

a first outer layer defining a relatively hard outer shell, a second layer of cellular plastic disposed within said outer layer and supporting same, a third layer of non-cellular plastic abutting the inside surface of said second layer and peripherally joined by molding to the peripheral portions of said first layer so as to form an enclosure for said cellular plastic with said first layer, said third layer being shaped to substantially conform to the shape of the skull of the wearer and defining a unitary molded structure with said first and second layers, and said first and third layers being formed of a unitary hollow plastic molding containing an interior volume enclosed by said first and third layers, said second layer being formed of a self expanding plastic resin which is molded in-situ within said volume enclosed within said hollow molding.

2. A composite molding in accordance with claim 1 wherein said first layer is substantially thicker than said third layer and said second layer is greater in thickness than said first and third layers.

3. A composite molding in accordance with claim 2 wherein said first layer is of substantially greater rigidity than said third layer.

4. A composite molding in accordance with claim 2 wherein said second and third layers are both substantially greater in flexibility than the material composing said first layer.

5. A composite molding in accordance with claim 1 wherein said first layer and said third layer are molded of a high impact resistant plastic and said second layer is molded of relatively flexible plastic whereby said second layer may inwardly deform during impact.

6. A composite molding in accordance with claim 1 wherein said second layer is composed of a plurality of cellular plastic materials of different rigidity.

7. A composite molding in accordance with claim 6 wherein said second layer contains at least two coextending stratum including an outer stratum formed of a first rigid cellular plastic material and an inner stratum formed of a second flexible cellular plastic material.

8. A composite molding in accordance with claim 1 including a gas under pressure disposed between said first and third layers for supporting at least a portion of said third layer by the force of the gas thereagainst.

9. A safety headgear for use in protecting the head of the wearer thereof comprising:

a bowl-shaped shell-like unitary molding formed of a plurality of layers of plastic resinous material, said plastic molding having a first outer layer defining the outer surface of the molding and forming a relatively hard outer shell, a second layer of cellular plastic resin disposed beneath said outer layer and supporting said outer layer away from the head of the wearer, a third layer of non-cellular plastic resin molded against and beneath said second layer, said third layer being peripherally joined by molding to the peripheral portions of said first layer so as to form an enclosure with said first layer for the material of said second layer, said third layer being surface shaped to substantially conform to the shape of the skull of the wearer and defining a unitary molded structure with said first and second layers, and said first and third layers defining a unitary hollow plastic molding surrounding an interior volume enclosed thereby, said second layer being formed of a cellular plastic material which is molded in-situ within and completely fills said interior volume defined by said first and third layers of resin.

* * * * *